US011377795B2

(12) United States Patent
Jännetyinen et al.

(10) Patent No.: US 11,377,795 B2
(45) Date of Patent: Jul. 5, 2022

(54) SHOE PRESS BELT

(71) Applicant: Valmet Technologies Oy, Espoo (FI)

(72) Inventors: Jari Jännetyinen, Sastamala (FI); Vesa-Matti Riihioja, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/264,732

(22) PCT Filed: Dec. 17, 2019

(86) PCT No.: PCT/FI2019/050898
§ 371 (c)(1),
(2) Date: Jan. 29, 2021

(87) PCT Pub. No.: WO2020/152392
PCT Pub. Date: Jul. 30, 2020

(65) Prior Publication Data

US 2021/0340707 A1 Nov. 4, 2021

(30) Foreign Application Priority Data

Jan. 25, 2019 (FI) ..... 20195046

(51) Int. Cl.
*D21F 3/02* (2006.01)
*B30B 9/24* (2006.01)
*D21F 7/08* (2006.01)

(52) U.S. Cl.
CPC ..... *D21F 3/0227* (2013.01); *B30B 9/247* (2013.01); *D21F 7/083* (2013.01)

(58) Field of Classification Search
CPC ..... D21F 3/0227; D21F 7/083; B30B 9/247
See application file for complete search history.

(56) References Cited

U.S. PATENT DOCUMENTS 6,029,570 A 2/2000 Matuschczyk
2006/0011320 A1* 1/2006 Davis ..... D21F 3/0227 162/358.4
2010/0101746 A1* 4/2010 Takano ..... D21F 3/0236 162/358.2

FOREIGN PATENT DOCUMENTS

EP 0881327 A2 12/1998
WO 2004094720 A1 11/2004
WO 2007042623 A1 4/2007

OTHER PUBLICATIONS

International Preliminary Report on Patentability for PCT/FI2019/050898 dated Nov. 19, 2020.

* cited by examiner

*Primary Examiner* — Eric Hug
*Assistant Examiner* — Matthew M Eslami
(74) *Attorney, Agent, or Firm* — Stiennon & Stiennon

(57) ABSTRACT

A shoe press belt (10) for a shoe press has an inner surface (11), an outer surface (12), an elastomer body and a support structure (20, 21, 22, 23) for the elastomer body. A plurality of parallel dewatering grooves (50, 50*a*, 50*b*) are on the outer surface (12) of the shoe press belt (10), with a ridges (53) provided between two adjacent dewatering grooves (50*a*, 50*b*). The dewatering grooves (50, 50*a*, 50*b*) have a first wall (60), a second wall (70), and a bottom (80) therebetween. At least the first wall (60) of the dewatering groove (50, 50*a*, 50*b*) has a plurality of parallel auxiliary grooves (100, 100*a*, 100*b*). A paper, board or pulp drying machine has said shoe press belt (10). A method for installing the shoe press belt (10) is provided.

16 Claims, 5 Drawing Sheets

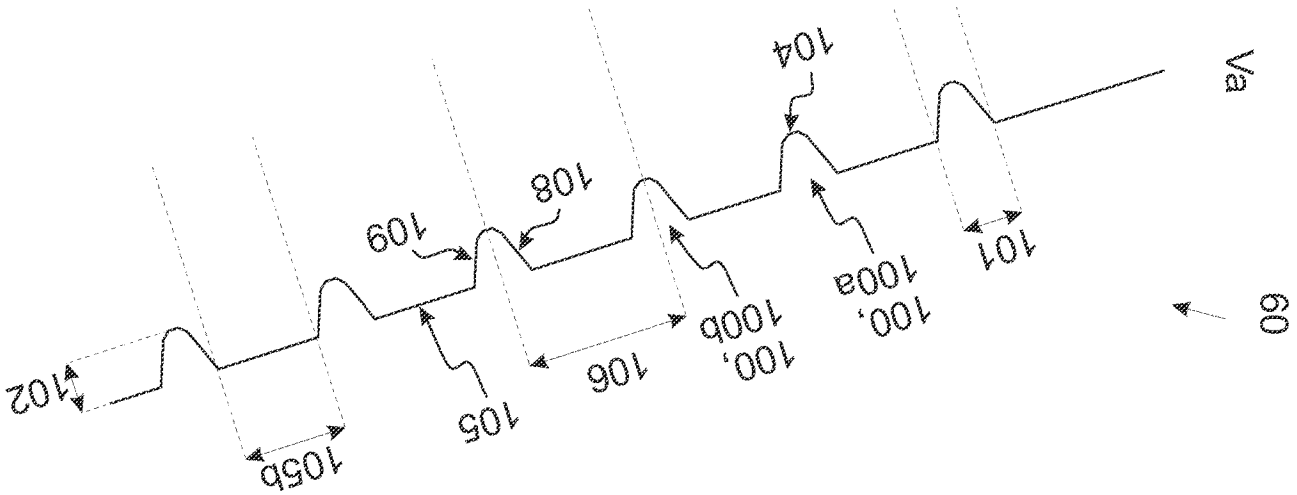
Fig. 5a
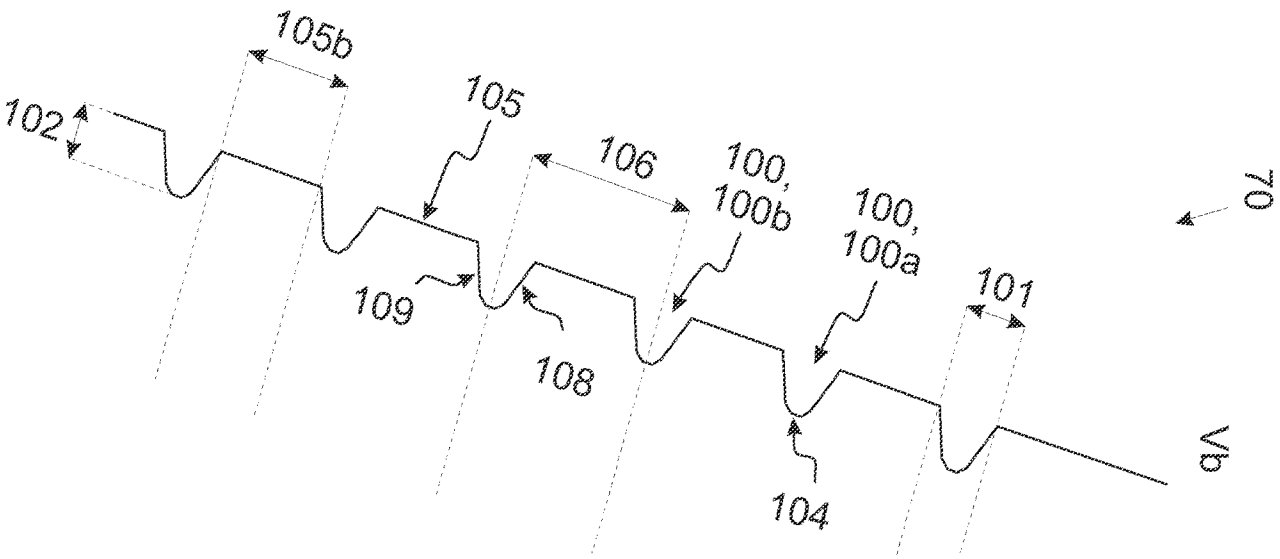
Fig. 5b
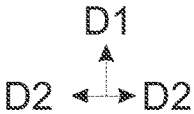

SHOE PRESS BELT

CROSS REFERENCES TO RELATED APPLICATIONS

This application is a National Stage application based on PCT/FI2019/050898, filed on Dec. 17, 2019 and claims priority on Finnish Application No. FI20195046, filed Jan. 25, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a press belt. Furthermore, the invention relates to a paper machine, a board machine or a pulp drying machine comprising a press belt. The invention also relates to a method for installing a press belt in a paper machine, a pulp drying machine, or a board machine.

Shoe presses are used, for example, in press sections of paper machines. Their function is typically to remove water from a fiber web. A shoe press normally comprises an immobile press shoe enclosed by a loop-shaped endless press belt. Said press belt may be called a shoe press belt.

SUMMARY OF THE INVENTION

The shoe press belt according to the invention is a shoe press installed and has a first wall of a dewatering groove having a plurality of parallel auxiliary grooves extending to the outer surface of the shoe press belt.

The paper machine, board machine or pulp drying machine according to the invention is characterized in that it comprises at least one, preferably at least two press belts according to the invention.

A press belt for a shoe press is preferably a piece in the shape of an endless loop, having an inner surface and an outer surface. The press belt preferably comprises an elastomer body comprising several aligned dewatering grooves on the outer surface of the press belt. Thus, a ridge is provided between two adjacent dewatering grooves. At least the first one of said dewatering grooves comprises:

- a first wall of the dewatering groove,
- a second wall of the dewatering groove, and
- a bottom of the dewatering groove, between the first wall and the second wall of the dewatering groove.

Furthermore, the press belt preferably comprises a supporting structure for the elastomer body, the supporting structure preferably comprising several reinforcing yarns embedded in said elastomer body. Said elastomer body may comprise at least 50 wt %, preferably at least 70 wt % polyurethane.

The first wall of the dewatering groove of the press belt may comprise several parallel auxiliary grooves in the dewatering groove, extending to the outer surface of the press belt. Furthermore, the second wall of the dewatering groove may comprise several parallel auxiliary grooves in the dewatering groove, extending to the outer surface of the press belt.

The number of said auxiliary grooves in the dewatering groove may be at least 200/m, measured from one dewatering groove in the longitudinal direction of said dewatering groove. More advantageously, the number of said auxiliary grooves in the dewatering groove is at least 200/m, measured from one wall of one dewatering groove, in the longitudinal direction of said dewatering groove. Preferably, the total number of said auxiliary grooves in the dewatering groove is at least 400/m, measured from both walls of one dewatering groove, in the longitudinal direction of said dewatering groove. Said plurality of auxiliary grooves in the dewatering groove enhance the removal of water from the web, and their function can increase as the number of auxiliary grooves in the dewatering groove increases so that the best result can be achieved when the number of said auxiliary grooves in the dewatering groove is at least 400/m, measured from both walls of one dewatering groove, in the longitudinal direction of said dewatering groove.

At least one auxiliary groove in the dewatering groove may have a slightly curved shape so that the radius of curvature 100R of said at least one auxiliary groove is at least 10 mm. Advantageously, the number of auxiliary grooves having said slightly curved shapes is at least 100/m, more advantageously at least 200/m and preferably at least 400/m, measured from one dewatering groove in the longitudinal direction of said dewatering groove. Said slightly curved shape may enhance the removal of water from the fiber web to be dewatered.

Measured in the direction transverse to the direction of rotation of the press belt, the number of such dewatering grooves whose walls comprise auxiliary grooves which preferably extend to the outer surface of the press belt, is at least 140/m. The effect of the auxiliary grooves in the dewatering grooves is typically enhanced when the number of dewatering grooves comprising auxiliary grooves is increased.

The plurality of parallel auxiliary grooves in the dewatering groove may be arranged in such a way that each auxiliary groove extends in a direction forming an angle $\alpha$ of at least 5° to the bottom of said dewatering groove. Furthermore, the distance between the central lines of two adjacent auxiliary grooves to a dewatering groove is preferably at least 1 mm and not greater than 5 mm.

The width of an auxiliary groove to a dewatering groove may be at least 0.1% and not greater than 6.5% of the width of the dewatering groove. Furthermore, the depth of an auxiliary groove to a dewatering groove may be at least 0.1% and not greater than 6.5% of the depth of the dewatering groove. The depth of the first dewatering groove may be at least 0.4 mm and preferably not greater than 2.0 mm. The dimension of an auxiliary groove to a dewatering groove in the depth direction is preferably at least 60% with respect to the depth of the dewatering groove. Preferably, the dewatering grooves extend substantially in the direction of rotation of the press belt.

In the method for installing a press belt in a paper machine, a pulp drying machine or a board machine, a press belt according to the invention is preferably provided and installed in connection with a shoe press.

Thanks to the above-described auxiliary grooves in the wall of the dewatering groove, it is possible, among other things, to enhance the removal of water from the fiber web into the dewatering grooves and thereby to achieve a higher dry content of the fiber web. The higher dry content of the fiber web can be achieved, thanks to the auxiliary grooves, not only by enhancing the removal of water from the fiber web to the dewatering grooves but also by enhancing the removal of water from said dewatering grooves. In this way, it is possible to have an indirect effect on the dewatering process in order to achieve a higher dry content of the fiber web, because water can be removed from the press belt more efficiently before the press belt is re-used for dewatering the web.

BRIEF DESCRIPTION OF THE DRAWINGS

In the following, the invention will be described in more detail with reference to the appended drawings.

FIGS. 5*a* and 5*b* show an example of auxiliary grooves to dewatering grooves in a cross-sectional view.

In FIGS. 1 to 5*b*, corresponding numerals or symbols refer to corresponding parts.

Figure 1:
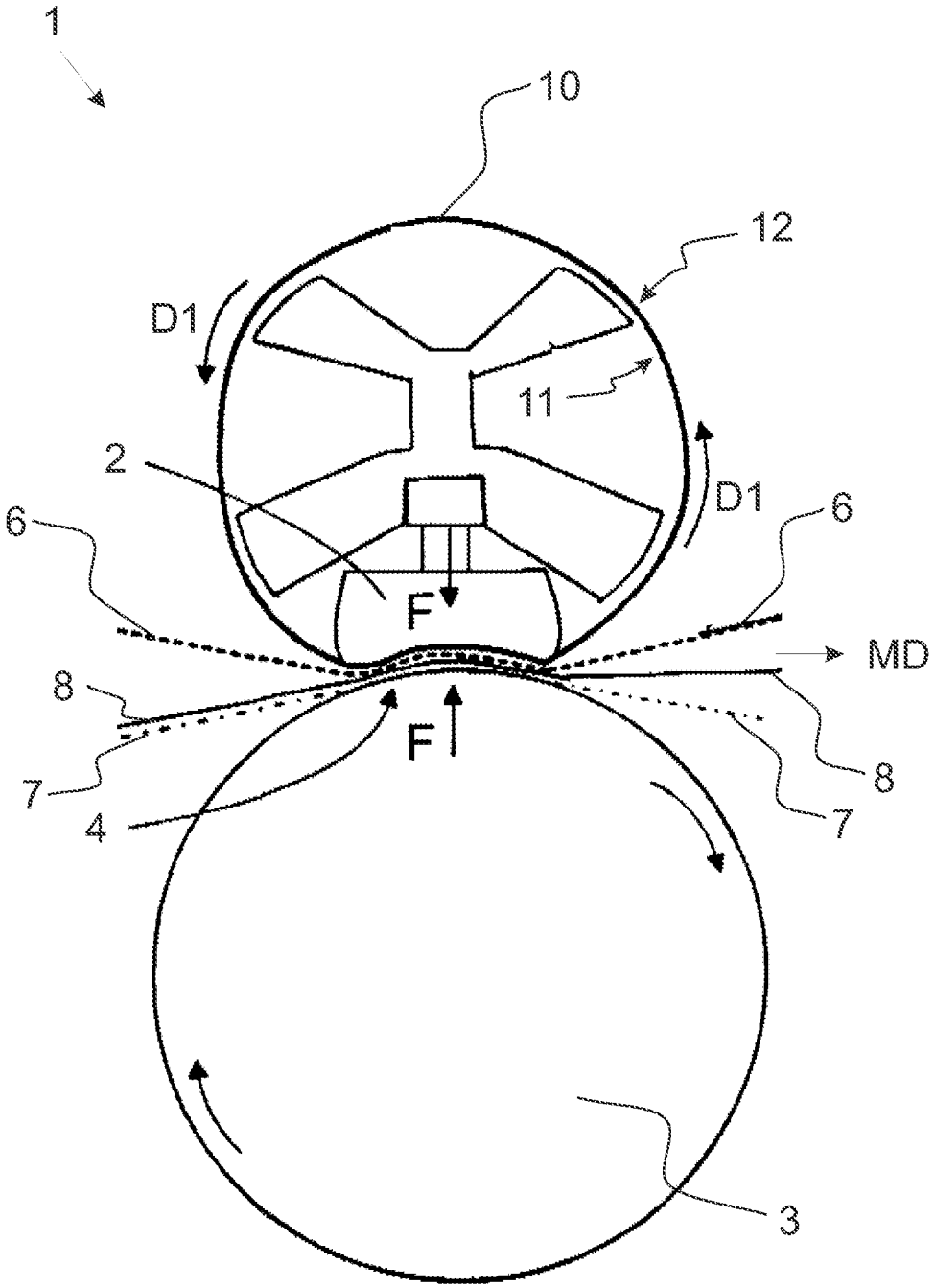
FIG. 1 shows an example of a shoe press belt installed in a shoe press.

The figures are illustrations which are not in scale.

DESCRIPTION OF THE PREFERRED EMBODIMENTS

In this application, the following reference numerals will be used:

1 shoe press,
2 press shoe,
3 counter roll,
4 press zone,
6 first paper machine fabric, for example press felt,
7 second paper machine fabric,
8 fiber web,
10 press belt for shoe press, i.e. shoe press belt,
10*a* thickness of shoe press belt,
D1 direction of rotation of shoe press belt, i.e. first longitudinal direction,
D2 second longitudinal direction of shoe press belt,
11 inner surface of shoe press belt,
12 outer surface of shoe press belt,
20 support structure for shoe press belt,
21 first layer of support structure for shoe press belt,
22 second layer of support structure for shoe press belt,
23 third layer of support structure for shoe press belt,
50, 50*a*, 50*b* dewatering groove of shoe press belt,
51 width of dewatering groove,
52 depth of dewatering groove,
53 ridge between two adjacent dewatering grooves 50*a*, 50*b*,
53*b* width of ridge 53 between dewatering grooves,
54 distance between central lines of two adjacent dewatering grooves,
60 first wall of dewatering groove,
70 second wall of dewatering groove,
80 bottom of dewatering groove,
100, 100*a*, 100*b* auxiliary groove of dewatering groove in a shoe press belt; i.e. auxiliary groove in a wall of a dewatering groove in a shoe press belt, 100R radius of curvature of auxiliary groove,
101 width of auxiliary groove 100, 100*a*, 100*b*,
102 depth of auxiliary groove 100, 100*a*, 100*b*,
103 length of auxiliary groove 100, 100*a*, 100*b*,
104 bottom of auxiliary groove 100, 100*a*, 100*b* for a dewatering groove,
105 ridge between two adjacent auxiliary grooves,
105*b* width of ridge between two adjacent auxiliary grooves,
106 distance between central lines of two adjacent auxiliary grooves,
107 dimension of auxiliary groove to a dewatering groove in the depth direction of the dewatering groove with respect to the depth 52 of the dewatering groove,
108 first wall of auxiliary groove to a dewatering groove,
109 second wall of auxiliary groove to a dewatering groove,
$\alpha$ inclination of auxiliary groove with respect to the bottom of the dewatering groove 50, 50*a*, 50*b*,
$\omega$ inclination of auxiliary groove with respect to the first direction of the press belt, and
$\beta$ inclination of dewatering groove with respect to the vertical direction.

In this application, the terms first direction D1 and second direction D2 of the press belt will be used. The first direction D1 refers to the direction of rotation of the press belt 10. The second direction D2 refers to the longitudinal direction transverse to the direction of rotation D1 of the press belt 10. Furthermore, the term thickness 10*a* of the press belt 10 will be used, referring to the thickness of the press belt in the depth direction of the press belt, i.e. in the direction of the normal of the inner surface of the press belt.

Moreover, the terms machine direction (MD) and cross direction (CD) will be used in this application. The machine direction MD refers to the running direction of the fiber web. This direction substantially corresponds to the direction of rotation of the press belt 10, i.e. the first direction D1 at that point of the press belt 10 which is against the fiber web 8.

The cross direction CD refers to the longitudinal direction transverse to the running direction, i.e. the machine direction MD, of the fiber web 8. The cross direction CD corresponds to the second direction D2 of the shoe press belt 10, that is, the longitudinal direction transverse to the running direction D1 of the shoe press belt.

In the present application, substantially parallel to the machine direction MD means that the direction does not deviate from said machine direction MD by more than 10 degrees, more advantageously not by more than 5 degrees, and preferably not by more than 3 degrees. Substantially parallel to the first direction D1 of the press belt means, in this application, that the direction does not deviate from said first direction D1 by more than 10 degrees, more advantageously not by more than 5 degrees, and preferably not by more than 3 degrees. Substantially parallel to the cross direction CD and substantially parallel to the second direction D2 means, in this application, that the direction does not deviate from said cross direction CD, i.e. the second direction D2, by more than 10 degrees, more advantageously not by more than 5 degrees, and preferably not by more than 3 degrees. Substantially diagonally arranged means, in this application, that the direction deviates from the cross direction by 30 to 60 degrees, preferably by 40 to 50 degrees.

Shoe presses 1 are typically used in the press section of a paper machine, a pulp drying machine or a board machine. FIG. 1 shows a reduced view of the arrangement of a shoe press belt 10 in a shoe press 1.

The shoe press 1 equipped with the shoe press belt 10 can be used for dewatering a fiber web 8. The shoe press 1 typically comprises a counter roll 3 and a press shoe 2, a press zone 4 being formed between them. Thus, an extended press zone, i.e. a so-called long nip, is formed between the press shoe 2 and the counter roll 3. The function of the shoe press 1 is typically to remove water from the fiber web 8.

The shoe press belt 10, at least one paper machine fabric 6, 7, preferably two paper machine fabrics 6, 7, and the fiber web 8 to be dewatered, are arranged to be run through the press zone 4 in the machine direction (MD). Said fiber web 8 is thus supported by at least one paper machine fabric 6, 7, such as a felt and/or a wire.

The shoe press belt 10 is or can be arranged in connection with the shoe press 1 in such a way that its outer surface 12 faces the fiber web 8 and its inner surface 11 faces the press shoe 2. One surface of the wet fiber web 8 is typically compressed by the rotating counter roll 3 while the other surface of the fiber web 8 is compressed by the immobile press shoe 2 which is encircled by the shoe press belt 10 having a flexible body and the shape of a loop.

In operation, the shoe press belt 10 typically runs through the press zone 4 between at least one counter roll 3 and the press shoe 2. Advantageously, a paper machine fabric 6, preferably a press felt, is fitted, or is configured to be fitted, against the shoe press belt 10. On top of the press felt or corresponding paper machine fabric 6, 7, the fiber web 8 is conveyed through the shoe press 1 so that the outer surface 12 of the shoe press belt 10 is in direct contact with the paper machine fabric 6, preferably press felt, and the inner surface 11 of the shoe press belt 10 slides against the sliding surface of the press shoe 2.

Typically, the press shoe 2 and the counter roll 3 are pressed against each other in the press zone in such a way that the shoe press belt 10, at least one paper machine fabric 6, 7 and the fiber web 8 to be dewatered, all run in the nip between the press shoe 2 and the counter roll 3, are compressed. For example, the press felt is typically configured to be compressed in the press zone and to substantially reassume its initial thickness after the compression.

Figure 2A:
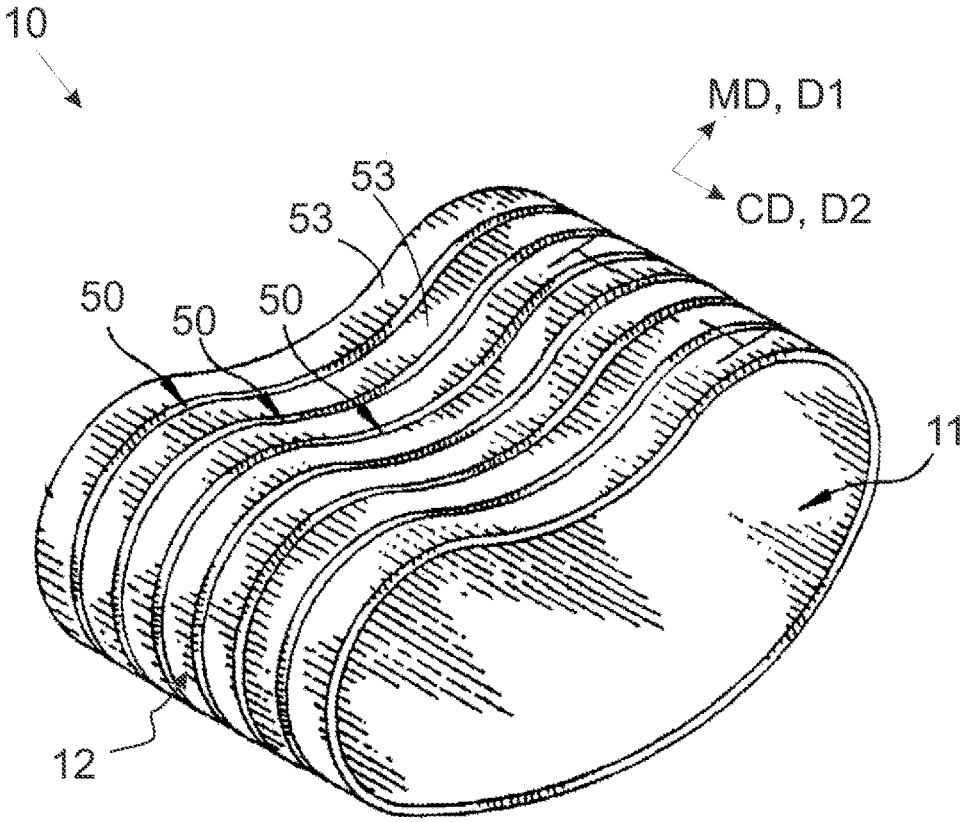
FIG. 2*a* shows an example of a shoe press belt.

FIG. 2*a* shows an example of a shoe press belt 10. In the present application, the press belt for a shoe press, i.e. the shoe press belt 10, refers to a press belt having the shape of an endless loop, intended for use in connection with a shoe press 1. Preferably, the shoe press belt 10 is suitable for use in a shoe press in the press section of a paper machine, a pulp drying machine, and/or a board machine.

The shoe press belt 10 has an inner surface 11 and an outer surface 12. On the outer surface 12 of the shoe press belt, dewatering grooves 50 are provided, as well as ridges between them.

The shoe press belt 10 may or may not comprise a pattern on the inner surface 11 of the shoe press belt 10. The inner surface 11 of the shoe press belt preferably comprises a slight patterning, i.e. so-called buffing. The depth of the buffing may be, for example, 0 to 5 μm or 0.05 to 2.00 μm. Advantageously, the depth of the buffing is not greater than 5 μm, more advantageously not greater than 2.00 μm, and preferably not greater than 0.99 μm. Furthermore, the depth of the buffing may be advantageously at least 0.01 μm, more advantageously at least 0.05 μm and preferably at least 0.10 μm. Said roughness of the inner surface of the shoe press belt may have a substantial effect on the durability of the shoe press belt. For example, if the uniformity of the lubricating oil film on the inside were broken, the combination of the smooth metal surface of the shoe press and the rough inner surface of the shoe press belt would not be as sensitive to decelerate as the combination of the smooth metal surface of the shoe press and the smooth inner surface of the shoe press. In such a situation, the shoe press belt having an inner surface 11 with a buffing is not as easily damaged as a shoe press belt having a smooth inner surface. In other words, without the buffing of the inner surface 11, one point of the shoe press belt would, after breaking of the uniformity of the lubricating oil film, have a strongly decelerating effect due to the smooth surfaces, while the other parts would run at the previous speed. This may result in a permanent deformation in the shoe press belt.

The outer surface 12 of the shoe press belt preferably comprises a slight patterning, i.e. so-called buffing. The depth of the buffing on the outer surface 12 of the shoe press belt 10 may be, for example, 0 to 50 μm or 0.05 to 10.00 μm. The depth of the buffing on the outer surface 12 of the shoe press belt may be suitably not greater than 50 μm or not greater than 40 μm, more advantageously not greater than 20 μm or not greater than 10 μm, and preferably not greater than 5 μm or not greater than 3 μm. Furthermore, the depth of the buffing on the outer surface 12 of the shoe press belt 10 may be suitably at least 0.01 μm, more advantageously at least 0.05 μm, and preferably at least 0.10 μm. A suitable roughness of the outer surface of the shoe press belt may have advantageous effects on its action together with the paper machine fabric.

Preferably, the shoe press belt 10 comprises an elastic body which has a capacity to reassume its initial shape after being compressed. The shoe press belt 10 preferably comprises an elastomer material as its main raw material. Preferably, said elastomer material consists of polyurethane or contains primarily polyurethane. Suitably, the shoe press belt comprises at least 50 wt %, more advantageously at least 70 wt %, and preferably at least 80 wt % polyurethane, calculated from the total weight of the shoe press belt. Furthermore, the shoe press belt may comprise not more than 99.9 wt %, more advantageously not more than 97 wt % and preferably not more than 95 wt % polyurethane, calculated from the total weight of the shoe press belt. Polyurethane may improve the properties of the shoe press belt and be particularly suitable for use in combination with auxiliary grooves to dewatering grooves in the shoe press (shown e.g. in FIGS. 4*a* to 5*b*).

When polyurethane is used as the elastomer material, the polyurethane may be produced by a method of prior art. Preferably, the polyurethane is made by mixing a urethane pre-polymer having terminal isocyanate groups, with a chain extender, preferably a chain extender comprising amine groups (HN2—), OH groups, or mixtures of these.

The circumference of the shoe press belt 10 is determined to be such that the inner diameter of the shoe press belt 10, when in operation, will be suitable for the use. The inner diameter of the shoe press belt 10 in operation is suitably 0.7 to 2.5 m, more advantageously 1.0 to 1.9 m, and preferably 1.09 to 1.82 m.

The circumference of the shoe press belt 10, that is, the length of one rotation, is suitably at least 2.2 m, more advantageously at least 3.0 m, and preferably at least 3.4 m. Furthermore, the circumference of the shoe press belt is suitably not greater than 6.3 m, more advantageously not greater than 6.0 m, and preferably not greater than 5.8 m. The length of the shoe press belt in the cross direction is determined according to the machine width and may be, for example, 1.5 to 12.6 m.

The shoe press belt 10 comprises dewatering grooves 50, 50*a*, 50*b* on the outer surface 12 of the shoe press belt. Dewatering grooves 50, 50*a*, 50*b* of the shoe press belt 1 are shown particularly in FIGS. 2*a*, 2*b*, 3*a*, and 3*b*.

When the fiber web 8 is conveyed through the press zone 4 formed by the counter roll 3 and the press shoe 2, water is pressed out of it. Typically, at least part of said water passes through the paper machine fabric, such as the press felt 6, to the dewatering grooves 50, 50*a*, 50*b* on the outer surface 12 of the shoe press belt 10. The function of the dewatering grooves 50, 50*a*, 50*b* is to enhance the removal of water from the fiber web 8 to be dewatered by means of the shoe press belt 10 and thereby to increase the dry content of said fiber web 8. Preferably, the shoe press belt 10 comprises several parallel dewatering grooves 50, 50*a*, 50*b* on the outer surface 12 of said shoe press belt 10.

The dewatering grooves 50, 50*a*, 50*b* are preferably "endless" and substantially parallel to the first direction D1 of the shoe press belt 10; that is, they extend substantially in the direction of rotation of the shoe press belt 10 in use. In other words, in use, the shoe press belt 10 is fitted or is intended to be fitted in a target, such as the press section of a paper machine, in such a way that said dewatering grooves 50, 50*a*, 50*b* will, when facing the fiber web, preferably extend in the running direction of the fiber web, i.e. in the so-called machine direction MD, or at least substantially in the machine direction. The angle of the dewatering grooves with respect to the first direction, i.e. the direction of rotation of the shoe press belt, is advantageously not greater than 2°, such as, for example 0 to 2°, more advantageously not greater than 1°, and preferably not greater than 0.5°, such as 0.0 to 0.5°. In this way, dewatering can be particularly effective, especially when auxiliary grooves in the dewatering groove are provided.

The dewatering grooves 50, 50*a* 50*b* may be separate grooves extending around the shoe press belt 10, or they may be continuous spiral grooves. Also, the angle of the spiral dewatering grooves with respect to the first direction, i.e. the direction of rotation of the shoe press belt, is advantageously not greater than 2°, such as 0 to 2°, more advantageously not greater than 1°, and preferably not greater than 0.5°, such as 0.0 to 0.5°, because in this way dewatering can be particularly effective, particularly when auxiliary grooves in the dewatering groove are provided.

Each dewatering groove 50, 50*a*, 50*b* of the shoe press belt 10 comprises a first wall 60 of the dewatering groove 50, 50*a*, 50*b*, a second wall 70 of the dewatering groove, as well as a bottom 80 of the dewatering groove. A ridge 53 is provided between two adjacent dewatering grooves 50*a*, 50*b*, having a width 53*b*. Furthermore, the distance 54 between the central lines of two adjacent dewatering grooves 50*a*, 50*b* can be determined.

The depth 52 of the dewatering groove 50, 50*a*, 50*b* is advantageously at least 0.4 mm, more advantageously at least 0.7 mm and preferably at least 1.0 mm, and advantageously not greater than 2.0 mm, more advantageously not greater than 1.7 mm and preferably not greater than 1.5 mm, measured from the deepest point of the dewatering groove. The width 51 of the dewatering groove 50, 50*a*, 50*b* is advantageously at least 0.5 mm, more advantageously at least 0.7 mm and preferably at least 0.8 mm, and advantageously not greater than 2.0 mm, more advantageously not greater than 1.8 mm and preferably not greater than 1.6 mm. The distance 54 between the central lines of two parallel adjacent dewatering grooves 50*a*, 50*b* is advantageously at least 1.5 mm, more advantageously at least 1.8 mm and preferably at least 2.0 mm, and advantageously not greater than 7.0 mm, more advantageously not greater than 6.0 mm and preferably not greater than 4.5 mm. The width 53*b* of the ridge 53 between two dewatering grooves 50*a*, 50*b* is advantageously at least 1.0 mm, more advantageously at least 1.1 mm and preferably at least 1.2 mm, and advantageously not greater than 5.0 mm, more advantageously not greater than 3.5 mm and preferably not greater than 2.5 mm. The total water volume of the dewatering grooves 50, 50*a*, 50*b* is advantageously between 100 and 800 g/m2, more advantageously between 200 and 700 g/m2, and preferably between 300 and 600 g/m2. Factors effective on the water volume of the outer surface of the shoe press belt include the cross-sectional area of the dewatering grooves as well as the density of the dewatering grooves (number/m in the cross direction). Preferably, the number of dewatering grooves 50, 50*a*, 50*b* is at least 140/m, more advantageously at least 200/m and preferably at least 230/m, and advantageously not greater than 670/m, more advantageously not greater than 560/m, and preferably not greater than 500/m seen in the second direction, i.e. the cross direction.

With the above-mentioned features of the dewatering groove 50, 50*a*, 50*b* (depth, width, distance between central lines, width of ridge, water volume, number of dewatering grooves), water can be removed from the web more efficiently via said dewatering groove 50, 50*a*, 50*b*. Furthermore, such a structure may have features which are well compatible with the press felt. These benefits are typically realized the better, the more of above-mentioned features are implemented in the shoe press belt 10. Furthermore, the dewatering groove of the above-mentioned type may act particularly well together with auxiliary grooves 100, 100*a*, 100*b* in the wall of the dewatering groove (shown e.g. in FIGS. 4*a* to 4*c* and 5*a* to 5*c*), which may have an effect that clearly improves the production efficiency of the machine, such as a paper machine or a board machine.

The dewatering groove 50, 50*a*, 50*b* is preferably designed to have an upwards opening, substantially U-shaped or V-shaped cross section. A rounded and/or beveled shape of the bottom 80 of the dewatering groove 50, 50*a*, 50*b* may substantially improve the durability of the dewatering groove 50, 50*a*, 5*b* in use, as well as improve its dewatering properties. Furthermore, auxiliary grooves 100, 100*a*, 100*b* of the dewatering groove 50 may act particularly well with such shapes of the dewatering groove 50, 50*a*, 50*b*.

Figure 3A:
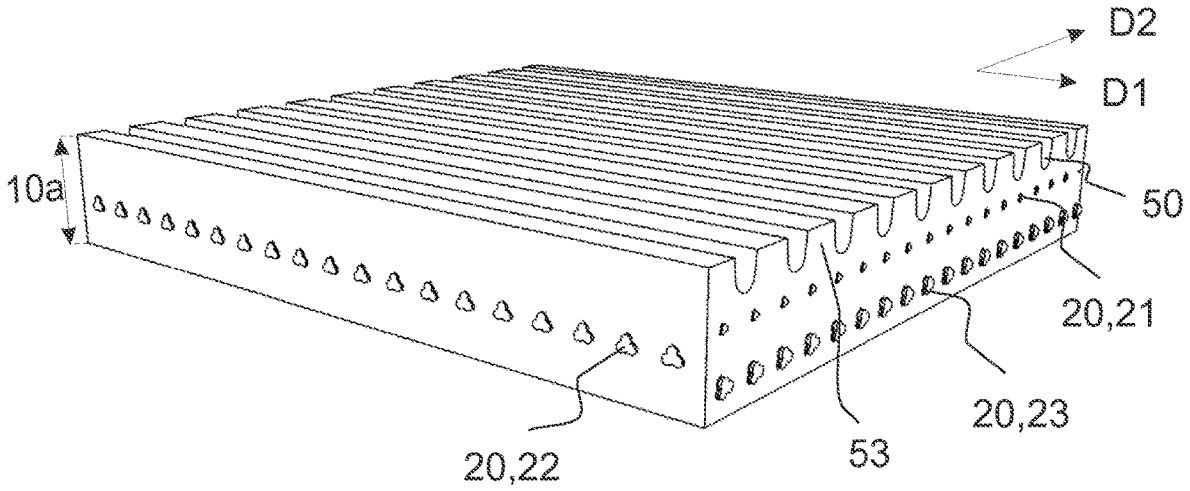
FIGS. 3*a* and 3*b* show an example of the internal structure of a shoe press belt.
Figure 3B:
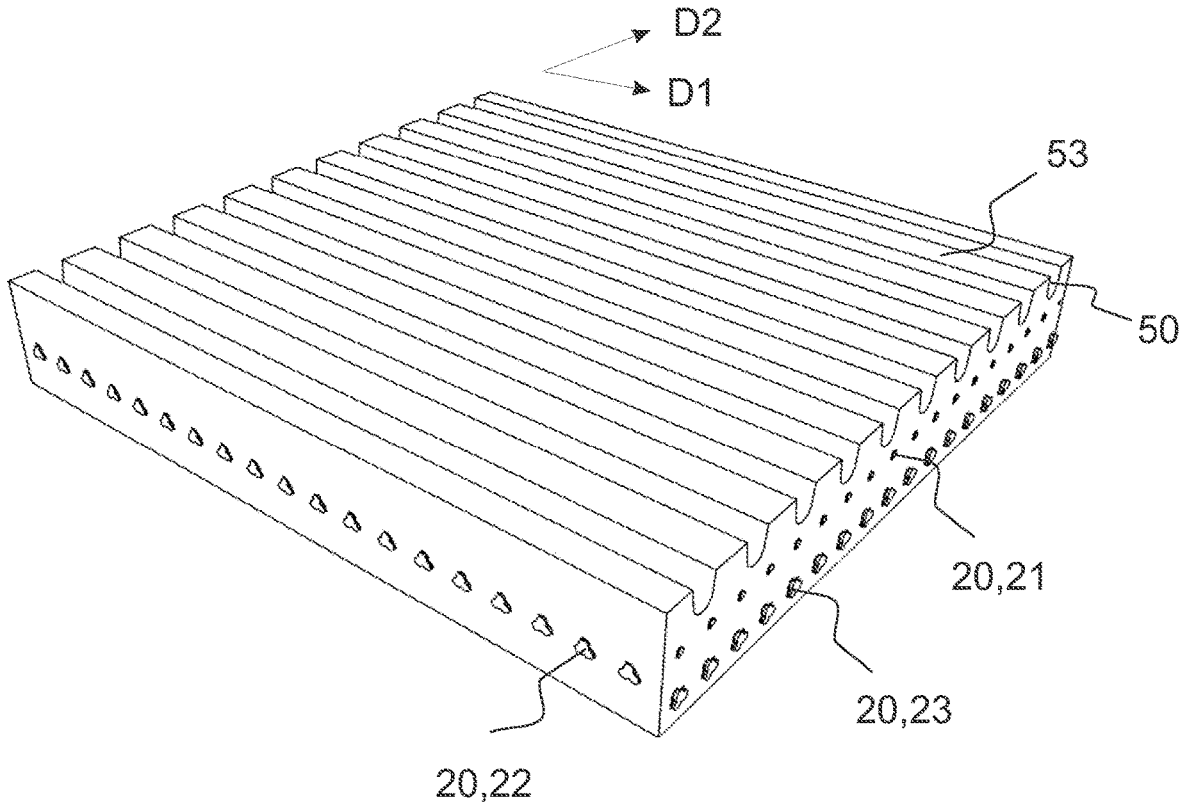

Preferably, the shoe press belt 10 is provided with a support structure 20, advantageously a support structure formed by yarns. FIGS. 3*a* and 3*b* show a support structure 20 according to an example, comprising a first layer 21 of the support structure formed by yarns, a second layer 22 of the support structure, as well as a third layer 23 of the support structure. The support structure 20 formed by yarns is preferably formed by embedding several reinforcing yarns in said elastic body. The reinforcing yarns are preferably arranged in one, two, three, or four layers within the elastic body. Preferably at least one, for example one or two reinforcing yarn layers 21, 23 are arranged in the first direction within the elastic body. Furthermore, preferably at least one, for example one or two reinforcing yarn layers 22 are arranged in the second direction, i.e. the cross direction, within the elastic body. Preferably, a total of three reinforcing yarn layers 21, 22, 23 are provided. The yarns in different layers may be either in contact with or bonded to the yarns of the next layer, or they may be spaced from each other. Preferably, the reinforcing yam layers 21, 22, 23, on top of each other are separated from each other.

Said reinforcing yarns may be separate yarns adjacent to each other, or they are formed of one or more yarns placed spirally in parallel. The adjacent reinforcing yarns of a single reinforcing yarn layer 21, 22, 23 may be spaced apart by, for example, 1 to 3 mm so that the area between the reinforcing yarns preferably consists of the elastic body material. The reinforcing yarns may be equal or different in thickness. The thickness of the reinforcing yarns may be, for example, 0.2 to 2.0 mm. The separate reinforcing yarns of the support structure 20 of the shoe press belt may be made of the same material or different materials. Preferably, the yarns comprise monofilament and/or multifilament yarns. Preferably, the support structure of the shoe press belt comprises yarns made of a polymer, preferably polyamide (PA), polypropylene (PP), polyethylene (PE), polyester (PET), polyvinyl alcohol (PVA, PVOH), polyaramide, polyphenylene sulfide (PPS), liquid crystal plastic (LCP), polyethylene naphthalate (PEN), and/or polyether ether ketone (PEEK).

Figure 2B:
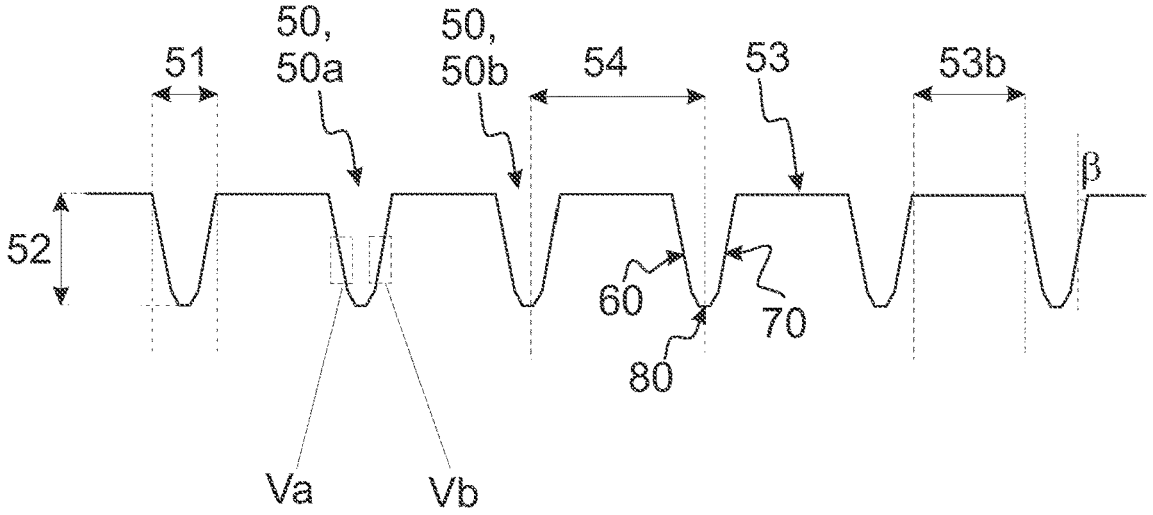
FIG. 2*b* shows an example of dewatering grooves in a shoe press belt, in a cross-sectional view.
Figure 4A:
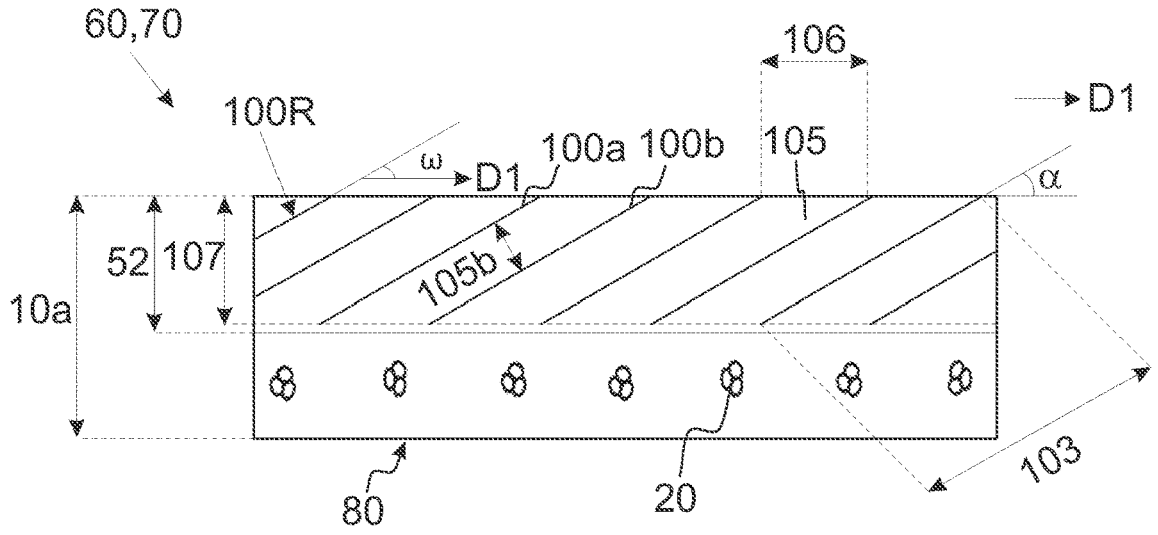
FIGS. 4*a* to 4*c* show some examples of auxiliary grooves to a dewatering groove in a shoe press belt.
Figure 4B:
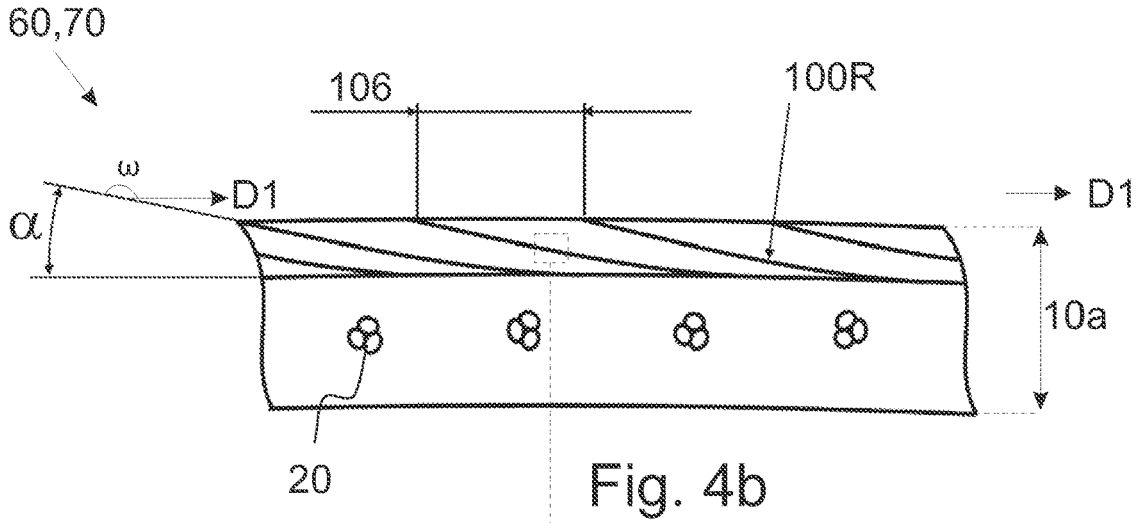
Figure 4C:
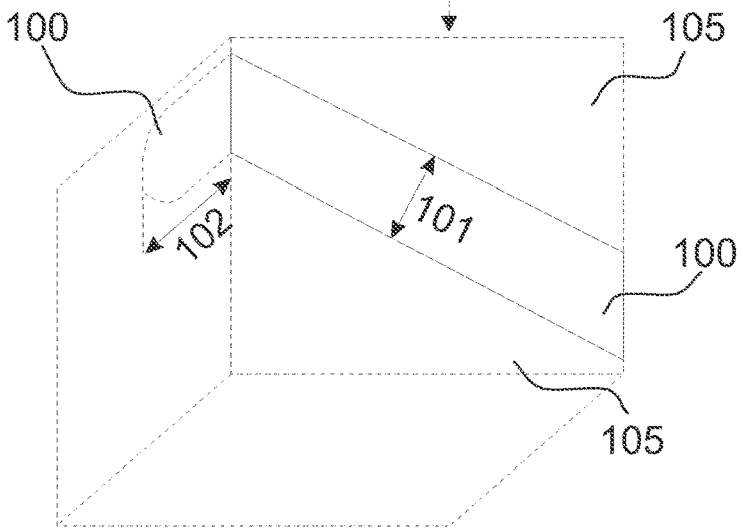

The shoe press belt 10 comprises auxiliary. grooves 100, 100*a*, 100*b* in the wall 60, 70 of the dewatering groove 50, 50*a*, 50*b*. Auxiliary grooves 100,100*a*, 100*b* in the dewatering groove 50, 50*a*, 50*b* of the shoe press belt 10 are illustrated particularly in FIGS. 4*a* to 4*c* and FIGS. 5*a* to 5*b*. FIGS. 4*a* to 4*c* show a part of a wall 60, 70 of a dewatering groove 50, 50*a*, 50*b* comprising auxiliary grooves 100, 100*a*, 100*b*. FIGS. 5*a* to 5*b* illustrate a possible groove structure of the auxiliary grooves 100, 100*a*, 100*b*. FIG. 5*a* shows an example of point Va of FIG. 2*b*, and FIG. 5*b* shows an example of point Vb of FIG. 2*b*.

The auxiliary grooves 100, 100*a*, 100*b* are preferably arranged in the shoe press belt 10 so that the first wall 60 of the dewatering groove 50, 50*a*, 50*b* comprises auxiliary grooves 100, 100*a*, 100*b* in the dewatering groove. Preferably, the second wall 70 of the dewatering groove also comprises said auxiliary grooves 100, 100*a*, 100*b* in the dewatering groove.

In this application, the auxiliary grooves 100 in the dewatering groove 50, 50*a*, 50*b* of the shoe press belt 10 refer to grooves arranged in the first wall 60 and/or the second wall 70 of the dewatering groove 50, 50*a*, 50*b*, and being clearly smaller than the dewatering groove 50, 50*a*, 50*b*. The auxiliary groove 100, 100*a*, 100*b* in a dewatering groove 50, 50*a*, 50*b* has a first wall 108, a second wall 109, and a bottom 104 between the walls 108, 109. Furthermore, it is possible to determine the width 101, the length 103, and the depth 102 of the auxiliary groove 100, 100*a*, 100*b*, as well as the ridge 105 between two adjacent auxiliary grooves 100*a*, 100*b* of a dewatering groove, as well as the distance 106 between the central lines of two adjacent auxiliary grooves 100*a*, 100*b* of a dewatering groove.

The depth 102 of the auxiliary groove 100, 100*a*, 100*b* of a dewatering groove may be at least 0.1%, more advantageously at least 0.3% and preferably at least 0.5% of the depth 52 of the dewatering groove 50, 50*a*, 50*b*. Further, the depth 102 of the auxiliary groove 100, 100*a*, 100*b* of a dewatering groove may be not greater than 6.5%, more advantageously not greater than 4.0% and preferably not greater than 2.5% of the depth 52 of the dewatering groove 50, 50*a*, 50*b*. The width 101 of the auxiliary groove 100, 100*a*, 100*b* of a dewatering groove may be at least 0.1%, more advantageously at least 0.3% and preferably at least 0.5% of the width 51 of the dewatering groove 50, 50*a*, 50*b*. Furthermore, the width 101 of the auxiliary groove 100, 100*a*, 100*b* of a dewatering groove may be not greater than 6.5%, more advantageously not greater than 40% and preferably not greater than 2.5% of the width 51 of the dewatering groove 50, 50*a*, 50*b*. The distance 106 between the central lines of two adjacent auxiliary grooves 100, 100*a*, 100*b* is advantageously at least 1 mm, more advantageously at least 1.3 mm and preferably at least 1.5 mm, and advantageously not greater than 5 mm, more advantageously not greater than 4.5 mm and preferably not greater than 4.0 mm.

Thanks to said properties (depth, width, distance between the central lines) of the auxiliary grooves 100, 100*a*, 100*b*, the dewatering properties of the shoe press belt 10 may be improved to a substantial extent. Furthermore, the shoe press belt 10 having said auxiliary grooves 100, 100*a*, 100*b* may help to improve the smoothness properties of the surface of the product (fiber web) to be manufactured. Thanks to this, the properties of the fiber web 8 to be made may be better than normal for post-treatment, which may make it easier to achieve better properties of the final product, such as a better coating result or calendering result of the fiber web 8. Furthermore, the shoe press belt 10 having said auxiliary grooves 100, 100*a*, 100*b* may make it easier to achieve the properties desired for the fiber web 8 to be manufactured, which may include, for example, improved bulk properties and/or a good moisture profile.

The total water volume (g/m2) of the auxiliary grooves 100, 100*a*, 100*b* of the dewatering groove is advantageously at least 0.1%, more advantageously at least 0.3% and preferably at least 0.5% of the total water volume of the dewatering grooves 50, 50*a*, 50*b*. Furthermore, the total water volume of the auxiliary groove 100, 100*a*, 100*b* of the dewatering groove is advantageously not greater than 6.5%, more advantageously not greater than 4.0% and preferably not greater than 2.5% of the total water volume of the dewatering groove 50, 50*a*, 50*b*. Thus, it is possible to achieve most effective dewatering of the fiber web 8 to be dewatered. Factors effective on said water volume of the auxiliary grooves 100, 100*a*, 100*b* in the wall 60, 70 of the dewatering groove include the cross-sectional surface of said auxiliary groove 100, 100*a*, 100*b* as well as the density of said auxiliary grooves in said wall (number/m in the longitudinal direction of the wall 60, 70 of the dewatering groove).

The depth 102 of the auxiliary groove 100, 100*a*, 100*b* in the wall 60, 70 of the dewatering groove 50, 50*a*, 50*b* may be advantageously at least 8 μm, more advantageously at least 10 μm and preferably at least 15 μm, and advantageously not greater than 110 μm, more advantageously not greater than 80 μm and preferably not greater than 50 μm. The width 101 of the auxiliary groove 100, 100*a*, 100*b* in the wall of the dewatering groove is thus advantageously at least 6 μm, more advantageously at least 10 μm, and advantageously not greater than 110 μm, more advantageously not greater than 80 μm and preferably not greater than 50 μm. With said properties of the auxiliary groove in the wall 60, 70 of the dewatering groove 50, 50*a*, 50*b*, the dewatering properties of the shoe press belt 10 can be substantially improved.

Preferably, the auxiliary grooves 100, 100*a*, 100*b* in the wall 60, 70 of the dewatering groove 50, 50*a*, 50*b* are substantially parallel; that is, the auxiliary grooves 100, 100*a*, 100*b* in one wall of one dewatering groove, or at least most of the auxiliary grooves, extend advantageously at an angle smaller than 15 degrees to each other, more advantageously at an angle smaller than 5 degrees to each other, and preferably at an angle smaller than 2 degrees to each other. In this way, the dewatering groove can be emptied more precisely than before, and/or the water can be removed from the web to the dewatering groove more effectively than before, both features contributing to an increase in the dry content of the fiber web 8 to be manufactured. In other words, thanks to the auxiliary grooves 100, 100*a*, 100*b* of the dewatering groove, water can exit the dewatering groove 50, 50*a*, 50*b* more effectively, and less rewetting can take place with respect to the felt or the web.

The wall 60, 70 of the dewatering groove 50, 50*a*, 50*b* comprising auxiliary grooves 100, 100*a*, 100*b* is advantageously at an angle β of 0 to 25 degrees to the normal of the surface of the shoe press belt 10 (shown in FIG. 2*b*); more advantageously, the wall 60, 70 of the dewatering groove 50, 50*a*, 50*b* is at an angle β of at least 5 degrees and preferably at least 10 degrees to the normal of the inner surface 11 of the shoe press belt 10, and also more advantageously at an angle β not greater than 20 degrees and preferably not greater than 15 degrees to the normal of the inner surface 11 of the shoe press belt 10. Thus, the drying effect of the auxiliary grooves 100, 100*a*, 100*b* on the fiber web may be enhanced.

The auxiliary groove 100, 100*a*, 100*b* in the wall 60, 70 of the dewatering groove 50, 50*a*, 50*b* may be at an angle α of at least 5°, more advantageously at an angle α of at least 6°, and preferably at an angle α of at least 7° to the bottom of said dewatering groove 50, 50*a*, 50*b*. Furthermore, the auxiliary groove 100, 100*a*, 100*b* in the wall 60, 70 of the dewatering groove 50, 50*a*, 50*b* may be at an angle α not greater than 30°, more advantageously at an angle α not greater than 27°, and preferably at an angle α not greater than 23° to the bottom of said dewatering groove 50, 50*a*, 50*b*. Thus, the orientation of the auxiliary grooves 100, 100*a*, 100*b* may be particularly suitable for dewatering the fiber web so that water can be effectively removed from the fiber web by means of the shoe press belt.

To enhance the advantageous effects, one dewatering groove advantageously comprises at least 200 said auxiliary grooves 100 per one meter. The number of auxiliary grooves 100, 100*a*, 100*b* in the wall 60, 70 of one dewatering groove is advantageously at least 200/m, more advantageously at least 230/m, and preferably at least 250/m. Furthermore, the number of auxiliary grooves 100, 100*a*, 100*b* in the walls 60, 70 of one dewatering groove is advantageously not greater than 1000/m, more advantageously not greater than 800/m, and preferably not greater than 670/m, seen in the longitudinal direction of said wall 60, 70, i.e. in the longitudinal direction of the dewatering groove 50, 50*a*, 50*b*.

The auxiliary grooves 100, 100*a*, 100*b* having above-mentioned advantageous features, the auxiliary grooves 100, 100*a*, 100*b* of the dewatering grooves can be used to achieve more effective transfer of water from the fiber web 8 to the dewatering grooves 50, 50*a*, 50*b* and/or more controlled and better removal of water, accumulated in the dewatering grooves 50, 50*a*, 50*b*, from the dewatering grooves. The more water can be removed from the fiber web 8 to the dewatering grooves 50, 50*a*, 50*b* of the shoe press belt 10, the higher the dry content of the fiber web 8 that can be achieved. Further, the more effectively the water accumulated in the dewatering grooves is removed from the dewatering grooves before they are filled with water again, the higher the dewatering and the dry content of the fiber web 8 that can be achieved. The higher dewatering capacity may substantially improve the runnability of the whole web manufacturing machine, such as a paper machine, a board machine or a pulp drying machine, and improve the production efficiency of the machine.

Advantageously, the auxiliary groove 100, 100*a*, 100*b* of the dewatering groove has a slightly curved shape so that the radius of curvature 100R of the auxiliary groove may be at least 10 mm, more advantageously at least 30 mm, and preferably at least 45 mm. Furthermore, the radius of curvature 100R of the auxiliary groove is advantageously not greater than 250 mm, more advantageously not greater than 150 mm, and preferably not greater than 100 mm. The slight curvature of the auxiliary groove (shown in FIG. 4*b*) may enhance the removal of water from the shoe press belt in the direction of the normal of the surface instead of a direction tangential to the surface.

Thanks to the auxiliary grooves 100, 100*a*, 100*b* in the wall of the dewatering groove, the flow of water entered in the dewatering groove 50, 50*a*, 50*b* is typically not decelerated in the dewatering groove as much as in shoe press belts 10 of prior art, but the water flow rate in the dewatering groove remains high, whereby the removal of water from the dewatering groove is enhanced.

The auxiliary grooves in the wall of the dewatering groove may be particularly useful in shoe press belts comprising polyurethane polymer. Therefore, advantageously at least 50 wt %, more advantageously at least 70 wt %, and preferably at least 80 wt % of the shoe press belt consists of polyurethane. The content of polyurethane may be, for example, not greater than 99.9 wt %, and more advantageously not greater than 95 wt % of the shoe press belt.

The auxiliary grooves 100, 100*a*, 100*b* in the walls 60, 70 of the dewatering grooves 50, 50*a*, 50*b* of the shoe press belt 10 may increase the dewatering efficiency and thereby the production efficiency of the press section of the machine, such as a paper machine, a board machine, or a pulp drying machine, particularly when they are used in connection with dewatering grooves 50, 50*a*, 50*b* extending in the first direction, or substantially the first direction. Therefore, the shoe press belt 10 preferably comprises at least dewatering grooves extending in the first direction, or substantially the first direction (machine direction), comprising auxiliary grooves 100, 100*a*, 100*b* in the wall 60, 70 of the dewatering groove 50, 50*a*, 50*b*. The auxiliary grooves of the dewatering grooves can be made, for example, by the laser technique.

The thickness 10*a* of the shoe press belt 10 comprising auxiliary grooves 100, 100*a*, 100*b* in the wall of the dewatering groove, is preferably 3 to 6 mm, measured at the thickest point of the belt.

The shoe press belt 10 may also comprise grooves other than said dewatering grooves in the machine direction or substantially in the machine direction. For example, the shoe press belt 10 may comprise grooves in the cross direction CD or substantially in the cross direction. The shoe press belt 10 may also comprise grooves arranged diagonally or substantially diagonally.

In an advantageous embodiment, the essential idea is that the outer surface of the shoe press belt comprises endless dewatering grooves extending in only one direction, as well as ridges between said parallel endless grooves, extending in the same direction.

The shoe press belt is intended to be installed in the shoe press of a machine, such as a pulp drying machine, a board machine, or a paper machine, preferably in the press section. The shoe press may be provided with a number of various devices known to a person skilled in the art, such as, for example, one or more water extracting devices for removing water from a press belt in connection with the shoe press, and/or water collecting troughs and/or doctor blades and/or other means for removing water from the grooves of the shoe press belt. Furthermore, the press section typically comprises a number of various apparatuses known to a person skilled in the art.

With the direction of installation of the shoe press belt 10, it is possible to influence the efficiency and way of operation of the auxiliary grooves 100, 100*a*, 100*b* in the shoe press belt 10 and thereby also the efficiency and the way of operation of the shoe press belt 10.

The shoe press belt 10 may be installed, or may be intended to be installed, in a first and/or a second installation direction. In the first installation direction, particularly the extraction of water from the web into the dewatering groove 50, 50*a*, 50*b* may be facilitated. In said first installation direction (shown in FIG. 4*a*), the auxiliary grooves 100, 100*a*, 100*b* in the wall form an angle ω smaller than 90° with respect to the direction of rotation D1 of the shoe press belt, and may effectively convey water into the dewatering groove 50. Thus, the auxiliary grooves may particularly facilitate the extraction of water from the fiber web 8 into the dewatering grooves. The first installation direction may be particularly favorable when the shoe press belt 10 is used in the upstream end of the press section, whereby the water content of the fiber web 8 is typically relatively high.

In an example, the angle ω of the auxiliary groove of the shoe press belt in the first installation direction, with respect to the direction of rotation D1 of the shoe press belt, can be determined from the equation $\omega=\alpha$ In the second installation direction (shown in FIG. 4*b*), particularly the removal of water collected in the dewatering groove 50, 50*a*, 50*b*, from the dewatering groove 50, 50*a*, 50*b*, can be facilitated. In the second installation direction, the auxiliary grooves 100 in the wall form an angle ω greater than 90° to the direction of rotation D1 of the shoe press belt. Thus, in particular, the auxiliary grooves may contribute to the removal of water from the dewatering groove 50, 50*a*, 50*b* and thereby enhance the removal of water collected in the dewatering grooves from the shoe press belt 10. Such a solution is particularly advantageous when the shoe press belt 10 is used at the downstream end of the press section, whereby the dry content of the fiber web 8 has already been increased to some extent. In an example, the angle ω of the auxiliary groove of the shoe press belt in the second installation direction can be determined from the equation $\omega=180-\alpha$.

In other words, the angle α, representing the inclination of the auxiliary groove 100 with respect to the bottom of the dewatering groove 50, 50*a*, 50*b*, is not dependent on the direction of rotation, i.e. the direction of installation, of the shoe press belt, whereas the angle ω is determined according to the direction of installation of the product. The angle α can be determined if the angle ω is known. Thus, in the first installation direction, $$\alpha=\omega$$

and in the second installation direction, the angle α can be calculated from the formula $$\alpha=180-\omega$$

Preferably, the machine, such as a pulp drying machine, a paper machine, or a board machine, in which the shoe press belt 10 having auxiliary grooves 100, 100*a*, 100*b* in the wall of the dewatering groove is installed, comprises two such shoe press belts 10, one being installed in the first installation direction, and the other in the second installation direction. Thus, in the running direction of the web, the first shoe press belt 10 is advantageously installed in such a way that the auxiliary grooves 100, 100*a*, 100*b* of the dewatering groove facilitate the removal of water from the dewatering groove 50, 50*a*, 50*b*. Furthermore, the latter shoe press belt 10 in the running direction of the web is preferably installed in such a way that the auxiliary grooves 100 in the wall of the dewatering groove 50 contribute to the removal of water towards the dewatering groove. Such a system comprising two shoe presses and two shoe press belts 10 having auxiliary grooves 100, 100*a*, 100*b* in the dewatering grooves, may have particularly advantageous effects on the dewatering capacity of the press section of the machine, such as a paper machine, pulp drying machine or board machine, and thereby an improvement in the production efficiency of the machine.

As presented above, the auxiliary grooves in the wall of the dewatering groove may have a number of advantageous effects on the operation of the shoe press belt. They may, for example, intensify the removal of water, which may contribute to an increase in the web speed and the production efficiency in the machine having auxiliary grooves of the above presented type in the wall of the dewatering groove.

The features presented in this application are not separate examples independent of each other, but they can be combined in various combinations. The drawings and the description relating to them are intended to illustrate the idea of the invention, but a person skilled in the art will appreciate that the basic idea of the invention can be implemented in a variety of ways. Thus, the invention and its embodiments are not limited by the examples described above, but they can be varied within the scope of the claims.

The invention claimed is:

1. A shoe press belt having the shape of an endless loop with an inner surface and an outer surface, the shoe press belt comprising:

an elastomer body, wherein portions of the outer surface lying on the elastomer body define lands which extend between a plurality of parallel dewatering grooves, each of said grooves being recessed below the lands; and a support structure for the elastomer body, the elastomer body further comprising:

wherein a portion of the lands defines a ridge provided between two adjacent dewatering grooves, and at least a one of said dewatering grooves comprises:

a first wall of the dewatering groove;

a second wall of the dewatering groove;

a bottom of the dewatering groove between the first wall and the second wall of the dewatering groove, wherein the first wall of the dewatering groove comprises a first plurality of parallel auxiliary grooves of the dewatering groove extending to the outer surface of the shoe press belt;

wherein the first wall defines a wall plane which extends outwardly from the bottom to a land of the outer surface, and wherein the plurality of parallel auxiliary grooves are recessed into the elastomer body spaced from the wall plane, and wherein each of the plurality of auxiliary grooves has a width at the wall plane and a center line lying on the wall plane extends along the center of the width at each point along said auxiliary groove; and wherein the center line of at least one of the plurality of parallel auxiliary grooves of the dewatering groove has a curved shape such that the radius of curvature of said center line of the at least one auxiliary groove is at least 10 mm.

2. The shoe press belt of claim 1 wherein said second wall of the dewatering groove comprises a second plurality of parallel auxiliary grooves of the dewatering groove, extending to the outer surface of the shoe press belt.

3. The shoe press belt of claim 1 wherein the number of said auxiliary grooves of the dewatering groove is at least 200/m, measured in a longitudinal direction of said dewatering groove.

4. The shoe press belt of claim 1 wherein the shoe press belt comprises, measured in a cross direction with respect to the direction of rotation of said shoe press belt, at least 140/m dewatering grooves whose walls comprise auxiliary grooves extending to the outer surface of the shoe press belt.

5. The shoe press belt of claim 1 wherein said plurality of parallel auxiliary grooves of the dewatering groove are arranged so that each auxiliary groove where it exits said dewatering groove extends in a direction forming an angle α of at least 5° to the bottom of said at least one of the dewatering grooves.

6. The shoe press belt of claim 1 wherein the auxiliary grooves of said at least one of the dewatering grooves have a width which is at least 0.1% and not greater than 6.5% of a width of the dewatering groove.

7. The shoe press belt of claim 1 wherein the auxiliary grooves of said at least one of the dewatering grooves have a depth which is at least 0.1% and not greater than 6.5% of a depth of the dewatering groove.

8. The shoe press belt of claim 1 wherein a dimension of the auxiliary grooves of said first at least one of the dewatering grooves in a depth direction of the dewatering groove is at least 60% with respect to a depth of the dewatering groove.

9. The shoe press belt of claim 1 wherein a distance between center lines of two adjacent auxiliary grooves of said at least one of the dewatering grooves is at least 1 mm and not greater than 5 mm.

10. The shoe press belt of claim 1 wherein a depth of said at least one of said dewatering grooves is at least 0.4 mm.

11. The shoe press belt of claim 1 wherein said plurality of dewatering grooves extend essentially in a direction of rotation of said shoe press belt.

12. The shoe press belt of claim 1 wherein said elastomer body contains at least 50 wt % polyurethane.

13. A paper machine, a board machine, or a pulp drying machine comprising:

a shoe press belt having the shape of an endless loop with an inner surface and an outer surface, the shoe press belt comprising:

an elastomer body, wherein portions of the outer surface lying on the elastomer body define lands which extend between a plurality of parallel dewatering grooves, each of said grooves being recessed below the lands; and a support structure for the elastomer body, the elastomer body further comprising:

wherein a portion of the lands defines a ridge provided between two adjacent dewatering grooves, and at least a one of said dewatering grooves comprises:

a first wall of the dewatering groove;

a second wall of the dewatering groove;

a bottom of the dewatering groove between the first wall and the second wall of the dewatering groove, wherein the first wall of the dewatering groove comprises a first plurality of parallel auxiliary grooves of the dewatering groove extending to the outer surface of the shoe press belt; and wherein the first wall defines a wall plane which extends outwardly from the bottom to a land of the outer surface, and wherein the plurality of parallel auxiliary grooves are recessed into the elastomer body spaced from the wall plane, and wherein each of the plurality of auxiliary grooves has a width at the wall plane and a center line lying on the wall plane extends along the center of the width at each point along said auxiliary groove;

wherein the center line of at least one of the plurality of parallel auxiliary grooves of the dewatering groove has a curved shape such that that the radius of curvature of said center line of the at least one auxiliary groove is at least 10 mm.

14. A method for installing a shoe press belt in a paper machine, a pulp drying machine, or a board machine, the method comprising the step of:

installing in a shoe press:

a shoe press belt which has the shape of an endless loop with an inner surface and an outer surface, the shoe press belt comprising:

an elastomer body, wherein portions of the outer surface lying on the elastomer body define lands which extend between a plurality of parallel dewatering grooves, each of said grooves being recessed below the lands; and a support structure for the elastomer body;

the elastomer body further comprising:

wherein a portion of the lands defines a ridge provided between two adjacent dewatering grooves, and at least a one of said dewatering grooves comprises:

a first wall of the dewatering groove;

a second wall of the dewatering groove;

a bottom of the dewatering groove between the first wall and the second wall of the dewatering groove, wherein the first wall of the dewatering groove comprises a first plurality of parallel auxiliary grooves of the dewatering groove extending to the outer surface of the shoe press belt;

wherein the first wall defines a wall plane which extends outwardly from the bottom to a land of the outer surface, and wherein the plurality of parallel auxiliary grooves are recessed into the elastomer body spaced from the wall plane, and wherein each of the plurality of auxiliary grooves has a width at the wall plane and a center line lying on the wall plane extends along the center of the width at each point along said auxiliary groove; and wherein the center line of at least one of the plurality of parallel auxiliary grooves of the dewatering groove has a curved shape such that the radius of curvature of said center line of the at least one auxiliary groove is at least 10 mm.

15. The shoe press belt of claim 10 wherein the depth of said at least one of the dewatering grooves is not greater than 2.0 mm.

16. The shoe press belt of claim 12 wherein said elastomer body contains at least 70 wt % polyurethane.

* * * * *